US005272878A

United States Patent [19]

Schlichtig

[11] Patent Number: 5,272,878

[45] Date of Patent: Dec. 28, 1993

[54] AZEOTROPE ASSISTED POWER SYSTEM

[76] Inventor: Ralph C. Schlichtig, 11212 3rd. Ave. South, Seattle, Wash. 98168

[21] Appl. No.: 988,885

[22] Filed: Dec. 10, 1992

[51] Int. Cl.[5] ..... F01K 23/04

[52] U.S. Cl. ..... 60/655; 60/649

[58] Field of Search ..... 60/649, 655, 673, 675

[56] References Cited

U.S. PATENT DOCUMENTS

| | | | |
|---|---|---|---|
| 1,982,745 | 12/1934 | Koenemann | 60/649 |
| 3,218,802 | 11/1965 | Sawle | 60/649 |
| 3,258,925 | 7/1966 | Barthélemy | 60/649 |
| 3,822,554 | 7/1974 | Kelly | 60/655 |
| 5,027,602 | 7/1991 | Glen et al. | 60/649 |
| 5,209,065 | 5/1993 | Sakata | 60/649 |

*Primary Examiner*—Richard A. Bertsch
*Assistant Examiner*—Mark Sgantzos

[57] ABSTRACT

The azeotrope assisted power system is a double cycle engine with condenser at an available low temperature and which uses a refrigerant of low boiling point as working fluid, with its boiler held at an elevated constant temperature for good operating efficiency by thermal contact between the boiler and the condenser of an efficient azeotrope assisted heat pump. The efficiency of the heat pump cycle is increased by the use of an azeotrope mixture of two refrigerants which shows a vapor pressure versus temperature less steep than the similar curves for the separate component refrigerants. These are closed cycles with no mixing of fluids between the cycles. The heat pump compressor draws its required power from the engine cycle, leaving some useable energy. The efficiency of the engine cycle is helped by having a stable temperature in the boiler, and the over all efficiency is maintained by preheating the working fluid fed to the boiler by heat exchange with condensate leaving the condenser of the heat pump. The combined system allows the use of lower temperature heat to produce power.

4 Claims, 2 Drawing Sheets

AZEOTROPE ASSISTED POWER SYSTEM

This invention relates generally to a heat transfer and power system and more specifically to an azeotrope assisted heat pump for maintaining a suitable elevated temperature and pressure in the boiler of a vapor type heat engine for effecting the most efficient power output of the engine.

In vapor type heat engines the intake valve timing is fixed to permit a given expansion ratio within the power vapor enclosure which requires a fixed pressure ratio between the boiler and the condenser which in turn requires a fixed input temperature to the boiler. In conventional vapor type heat engines the temperature to the heat engine, namely the boiler of the engine, must be maintained by a temperature input heat that is higher than the temperature of the boiler. The heat is commonly supplied by oil or other types of fuel to maintain a stable operating temperature. In accordance with this invention, heat is supplied to the system at a temperature which may be varied, that is lower than the temperature within the power boiler. Further in accordance with this invention, without increasing the power input to the compressor of the heat pump, an azeotrope mixture of two refrigerants permits a greater temperature difference between the input of heat and the stable operating temperature within the power boiler.

Further, in accordance with this invention the efficiency of the overall system is increased by transferring heat from the condensate of the heat pump to the power fluid flowing into the power boiler of the vapor engine. Further power is salvaged from the heat pump condensate to drive a hydraulic motor.

OBJECTIVES OF THE INVENTION

Therefore, an object of this invention is to provide a vapor type heat engine which can operate from input heat which is lower than the temperature within the power boiler and thus permit the use of low grade input heat to the system.

Another object of this invention is to provide a vapor type heat engine which operates from a variable temperature heat input source.

A further object of this invention is to provide a vapor type heat engine that can be powered from a plurality of different temperature heat sources.

SUMMARY OF THE INVENTION

An azeotrope assisted power system including two vapor cycles thermally joined in a condenser boiler combination at a common relatively high temperature in which the first vapor cycle is a heat pump cycle utilizing an azeotrope fluid mixture having the characteristic that its saturated vapor pressure increases proportionately less rapidly with increase in temperature than does that of either component of the azeotrope fluid mixture; and the second vapor cycle is a power cycle utilizing a single power fluid. The first vapor cycle includes an evaporator containing the azeotrope fluid mixture, a vapor compressor for receiving such evaporated mixture from the evaporator and for delivering it at a higher pressure and temperature to the condenser portion of the condenser boiler combination, and a heat exchanger for receiving such higher temperature condensed azeotrope and delivering it back to the evaporator. The second vapor cycle includes the condenser boiler combination in which power fluid in the boiler portion of the condenser boiler combination is vaporized and delivered to a vapor motor and then fed to a low temperature condenser from whence condensed fluid is delivered back through the heat exchanger where it is preheated before returning to the boiler portion of the condenser boiler combination.

DESCRIPTION OF THE PREFERRED EMBODIMENT

Figure 1:
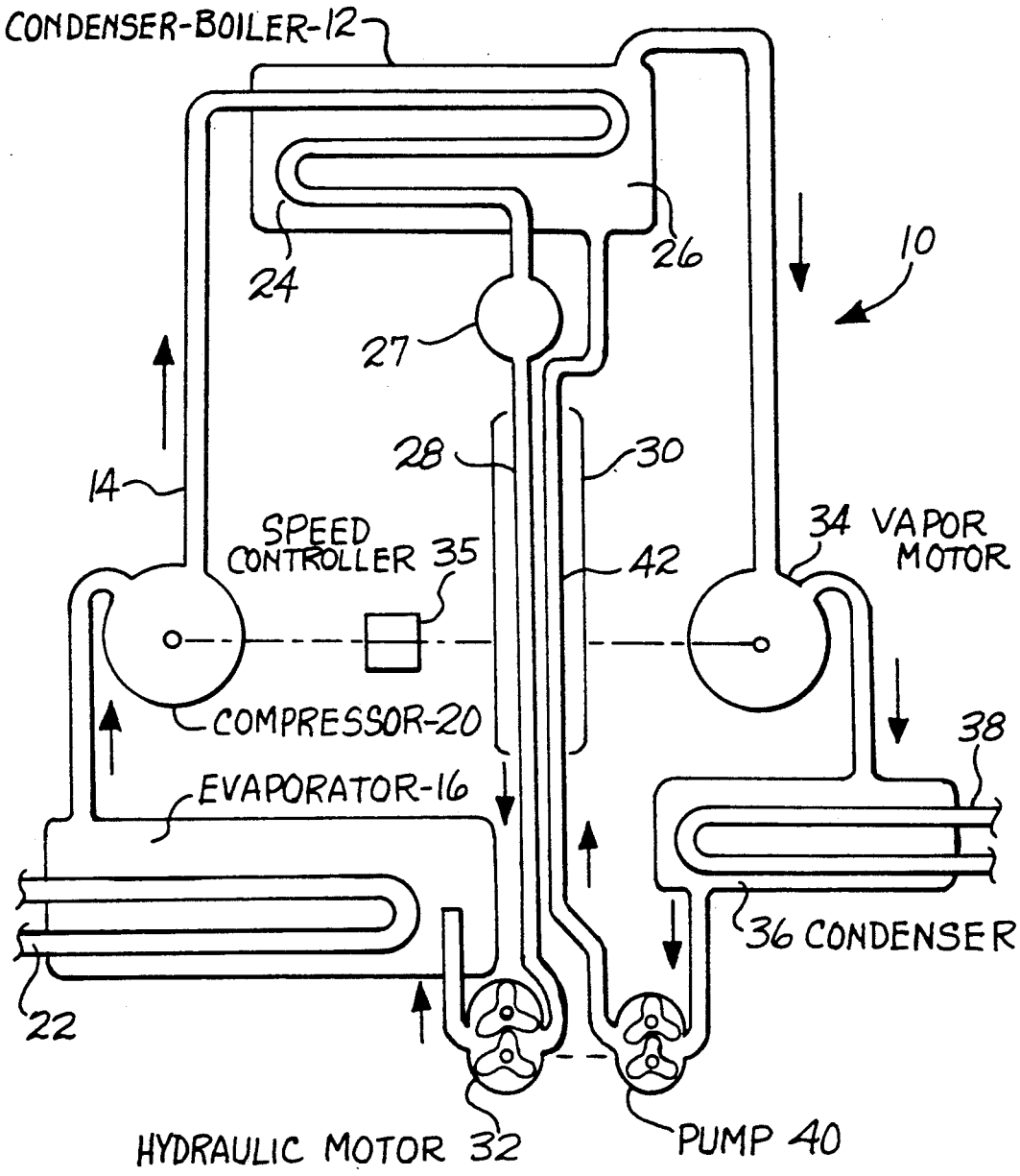
FIG. 1 is a schematic diagram illustrating an azeotrope assisted vapor power system embodying the teachings of this invention.
Figure 2:
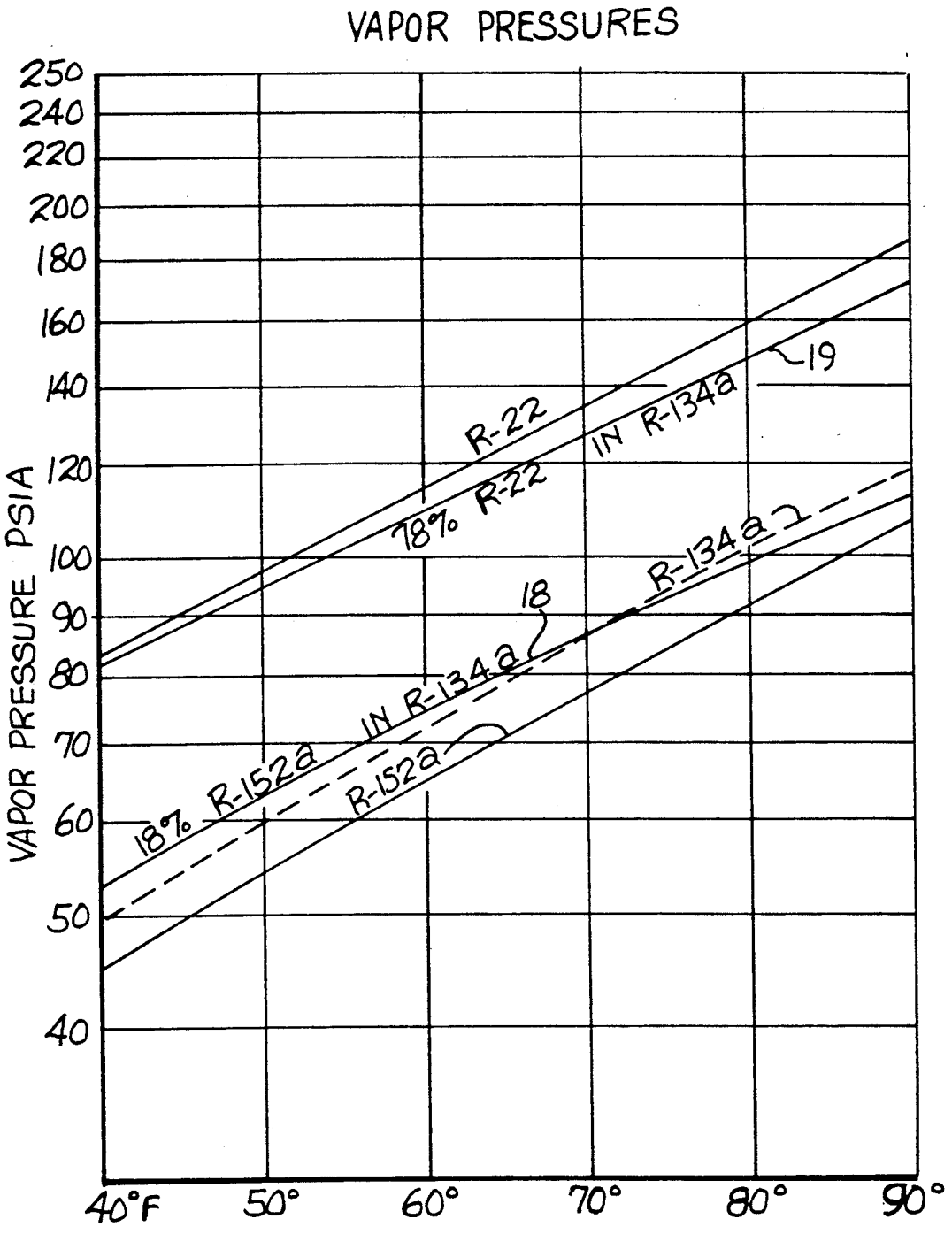
FIG. 2 is a graphic presentation of the relationship between the vapor pressure and the temperature of individual working fluids and azeotrope mixtures of such fluids.

As shown in FIG. 1 an azeotrope assisted power system 10 is illustrated embodying the teaching of this invention and includes two vapor cycles thermally joined at a common relatively high temperature in condenser-boiler combination 12. The first vapor cycle is a heat pump cycle 14 including an evaporator 16 enclosing an azeotrope fluid mixture having the characteristic that its saturated vapor pressure increases proportionately less rapidly with increase in temperature than does that of any of the components of the azeotrope fluid mixture. A suitable azeotrope is an azeotrope of two refrigerants such as R-134a and R-152a as illustrated by the pressure-temperature curve 18 as shown in FIG. 2 or an azeotrope of two refrigerants such as R-134a and R-22 as illustrated by the pressure-temperature curve 19. The use of such an azeotrope reduces the pressure ratio across a vapor compressor 20 and thus the energy required to compress a mole of the vaporized azeotrope.

Evaporation of the azeotrope within the evaporator 16 is brought about by heat delivered to the evaporator 16 from a heat source element 22. The heat pump cycle 14 also includes the vapor compressor 20 and a condenser portion 24 for delivering heat of vaporation to a power fluid contained within a boiler portion 26 of the condenser-boiler combination 12.

In operation, the vapor compressor 20 receives evaporated azeotrope fluid mixture from the evaporator 16 and compresses such evaporated azeotrope fluid mixture and then delivers the resulting compressed vapor to the condenser portion 24 where it is condensed to thereby give up its heat of vaporation. Both the condenser portion 24 and the boiler portion 26 operate at temperatures higher than that within the evaporator 16.

The heat pump cycle 14 also includes a condensate reservoir 27, heat exchange conduit 28, of a heat exchanger 30, for receiving heat containing condensate from the condenser portion 24 of the combination 12 and for cooling such condensate. A hydraulic motor 32 is disposed between the terminus of the heat exchanger conduit 28 of the heat exchanger 30 and the evaporator 16 for regulating the flow of condensed azeotrope mixture returning from the condenser portion 24 of the combination 12 to the evaporator 16 and for recovering the mechanical energy from such returning condensate.

The second vapor cycle is the power cycle and includes the boiler portion 26 of the combination 12 within which boiling of the power fluid, such as R-22 or R-152a, takes place to produce high pressure power vapor. The vapor pressure vs temperature curve for R-152a is steeper than that for the azeotrope mixture of R-152a and R-134a, as shown in the following Table 1. This is also true for R-22 which can also be used as a power fluid in the system 10, see Table 2. The working power fluid, such as R-152a or R-22 have molar heats of vaporation which are less than the molar heat of vaporation for the azeotrope as set forth in Table 1.

As seen in Table 1 the molar heat of vaporization for R-134a at 90° F. and thus for the azeotrope composed mostly of R-134a is 7930 BTU per mole while for R-22 it is but 6700 BTU per mole and for R-152a it is but 7799 BTU per mole. This assists in allowing a greater amount of power vapor generated in the boiler portion 26 of the combination 12 than the amount of heat pump vapor condensed in the condenser portion 24 of the combination. This assists in providing more energy output at a vapor motor 34 than the energy input to the compressor 20. The energy input to the compressor 20 is also reduced by the utilization of the azeotrope mixture in the evaporator 16 and by higher input temperatures to the evaporator 16.

TABLE 1

| Temp. °F. | Vapor Prssures Pure R-152A Psia | Azeotrope 17.8% R-152a/R-134a |
|---|---|---|
| 40 | 45.18 | 52.9 |
| 45 | 49.62 | 57.9 |
| 50 | 54.39 | 62.7 |
| 55 | 59.53 | 67.9 |
| 60 | 65.03 | 73.7 |
| 70 | 77.21 | 85.5 |
| 80 | 91.10 | 98.7 |
| 90 | 106.85 | 112.3 |
| 100 | 124.60 | 130.7 |
| 110 | 144.52 | 147.7 |
| 120 | 166.77 | 169.7 |

At
90° Heat of Vaporization of R-22 = 6700 BTU/Mole
90° Heat of Vaporization of R-152a = 7799 BTU/Mole
90° Heat Vaporization of R-134a = 7931 BTU/Mole

TABLE 2

| Temp. °F. | Vapor Pressures R-22 | R-134a | 78% R-22/R-134a | 65% R-22/R-134a |
|---|---|---|---|---|
| 34 | 74.8 | 43.7 | 74.7 | 70.6 |
| 40 | 83.2 | 49.2 | 81.7 | 77.1 |
| 50 | 98.7 | 59.6 | 94.7 | 92.1 |
| 60 | 116.3 | 71.6 | 110.7 | 106.6 |
| 70 | 136.1 | 85.36 | 129.2 | 126.6 |
| 80 | 158.3 | 101.07 | 149.2 | 146.8 |
| 90 | 183.1 | 118.8 | 170.0 | 167.6 |
| 100 | 210.6 | 139.0 | 194.7 | 193.6 |
| 110 | 241.0 | 161.5 | 221.7 | 219.7 |
| 120 | 274.6 | 186.6 | 252.7 | 248.5 |

In operation, the high pressure power vapor flows from the boiler portion 26 of the combination 12 into the vapor motor 34 where it expands and delivers power to the vapor motor 34, a part of or all of the power being used for driving the compressor 20. If desired, external heat transfer fins (not shown) can be provided on the exterior of the condenser-boiler combination 12 to discharge a portion of the heat delivered by the condenser portion 24, to thus permit the power system 10 to also operate as a heat transfer system. A speed controller 35 is provided in the linkage between the vapor motor 34 and the compressor 20 for controlling the relative speed between the vapor motor 34 and the compressor 20 to thus maintain the proper vapor pressure and temperature in the boiler portion 26. The vapor output from the vapor motor 34 flows into a low temperature condenser 36 where it is condensed by discharging its heat of vaporation to a cooling unit 38 which may be supplied with cooling water. The low temperature condenser 36 operates at a temperature below the temperature of the boiler portion 26 of the condenser boiler combination 12. The condensate power fluid flows from the condenser 36 into a liquid pump 40 which is driven primarily by the power output from the hydraulic motor 32. The liquid delivered from the liquid pump 40 flows through a heat exchange conduit 42 of the heat exchanger 30 where the liquid is preheated before returning to the boiler portion 26 of the combination 12. The heat for the preheating of the power liquid is supplied by condensate liquid flowing in the reverse direction through the conduit 28 of the heat exchanger 30.

OPERATION OF SYSTEM

Heat from a readily available heat source is supplied to the heat source element 22. In accordance with the teachings of this invention, the overall power system 10 may be supplied with heat from various sources at various temperatures which may be less than the temperature within the boiler portion 26 of the power cycle of the system 10. Normally, the pressure ratio across the power unit, such as the vapor motor 34, is fixed by the design of the power unit. For instance, a turbine power unit is normally designed for a fixed pressure ratio between the input and the output. This pressure ratio across the power unit must generally be considerable in order to provide suitable efficiency of operation. On the other hand a compressor, such as the compressor 20, can operate efficiently at variable pressure ratios between the discharge and the inlet of the compressor. Thus, in accordance with the teachings of this invention a constant and adequate temperature can be maintained in the boiler portion 26 of the power cycle to operate the vapor motor 34 efficiently with a variable temperature input and without using too much power in the compressor 20 by utilizing the aforementioned azeotrope as a working fluid. Normally in accordance with the prior art, fixed high temperature heat would have to be supplied to the boiler portion 26 for efficient operation of the power unit such as 34.

Vapor of sufficiently increased pressure flows from the compressor 20 into the condenser portion 24 of the combination 12 to maintain the required vapor pressure in the boiler portion 26. This is a normal characteristic of an ordinary compressor such as a piston type compressor with check valve output. The condensate leaving the condenser portion 24 carries a large amount of sensible heat which is valuable when transferred to the liquid in the conduit 42 of the heat exchanger 30. The preheated power liquid from the conduit 42 enters the boiler portion 26 where it requires considerable less heat for evaporation within boiler portion 26 than would be the case where no preheating takes place.

In operation, the evaporated power vapor within the boiler portion 26 of the combination 12 is at a pressure suitable for the design pressure of tho vapor motor 34 which, for example, may be a turbine. As hereinbefore mentioned, a part of or all of the power output of the vapor motor 34 is used to drive the compressor 20. The remaining power output of the vapor motor 34 is useable power.

The apparatus embodying the teachings of this invention has several advantages, for instance, simplicity of control Also the system 10 includes a pair of closed systems so the working fluids do not need to be replenished. The system has flexibility of accepted input heat sources The system 10 components are of well known construction. Further, heat transfer in the combination 12 between the condenser portion 24 and the boiler portion 26 is the most rapid type of heat transfer This keeps the relative size of equipment small.

I claim:

1. In an azeotrope assisted power system including two vapor cycles thermally joined at a common relatively high temperature in which the first vapor cycle is a heat pump cycle utilizing an azeotrope fluid mixture having the characteristic that its saturated vapor pressure increases proportionately less rapidly with increase in temperature than does that of any of the components of the azeotrope fluid mixture, and the second vapor cycle is a power cycle utilizing a power fluid, the combination in which the first vapor cycle includes an evaporator containing said azeotrope fluid mixture for receiving heat to evaporate said azeotrope fluid mixture, a vapor compressor for receiving such evaporated azeotrope fluid mixture from said evaporator and for delivering such evaporated azeotrope fluid mixture at a higher pressure and temperature, a condenser-boiler combination having a boiler portion and a condenser portion both operating at temperatures higher than that within said evaporator and containing a portion of the power fluid in the boiler portion for receiving such delivered vapor in the condenser portion of the condenser-boiler combination where it gives up its heat of vaporization for vaporizing such power fluid in the boiler portion at an elevated pressure, and a heat exchanger for receiving such higher temperature condensed azeotrope mixture and cooling such mixture before returning it back to said evaporator; and in which the second vapor cycle includes the boiler portion of the condenser-boiler combination in which boiling takes place to produce power vapor, a vapor motor for receiving such power vapor for generating power through vapor pressure reduction, a low temperature condenser operating at a temperature below the temperature within said boiler portion, for receiving the power vapor discharged from the vapor motor and condensing it back to a liquid by discharging heat of vaporization, and means for delivering the condensed power fluid from said low temperature condenser back through said heat exchanger for preheating the condensed power fluid by receiving heat from said azeotrope liquid mixture and returning the preheated power fluid to the boiler portion of said condenser-boiler combination.

2. The combination of claim 1 in which said vapor motor drives said vapor compressor.

3. The combination of claim 1 in which in the second vapor cycle the means for delivering the condensed power fluid from said low temperature condenser back through said heat exchanger includes a liquid pump.

4. The combination of claim 1 in which a hydraulic motor is included in the first vapor cycle between said heat exchanger and said evaporator for the purpose of recovering energy from the condensed azeotrope mixture returning from the condenser portion of said condenser boiler combination to said evaporator.

* * * * *